US006155514A

United States Patent [19]

Hailey et al.

[11] Patent Number: 6,155,514

[45] Date of Patent: Dec. 5, 2000

[54] AUTOMATIC LOADING OF COMPOSITE TAPE USING CASSETTES

[75] Inventors: Samuel I. Hailey; John W. Alden, both of Fort Worth, Tex.

[73] Assignee: The United States of America as represented by the Secretary of the Air Force, Washington, D.C.

[21] Appl. No.: 06/825,113

[22] Filed: Feb. 6, 1986

[51] Int. Cl.[7] ..... B65H 23/06

[52] U.S. Cl. ..... 242/422.4; 242/530.2

[58] Field of Search ..... 242/58, 58.6, 55, 242/67.3 R, 181; 156/361, 522, 577

[56] References Cited

U.S. PATENT DOCUMENTS

| | | | |
|---|---|---|---|
| 2,341,368 | 2/1944 | Flood | 206/58 |
| 2,575,129 | 11/1951 | Rubenstein | 312/63 |
| 3,188,014 | 6/1965 | Vergin | 242/181 X |
| 3,220,787 | 11/1965 | Latos | 242/181 X |
| 3,244,378 | 4/1966 | Rost | 242/181 X |
| 4,024,954 | 5/1977 | Staar | 206/387 |
| 4,286,790 | 9/1981 | Siryj et al. | 369/36 |
| 4,328,062 | 5/1982 | Off et al. | 156/353 |
| 4,351,688 | 9/1982 | Weiss et al. | 156/358 |
| 4,453,634 | 6/1984 | Blumenthal | 206/389 |
| 4,609,161 | 9/1986 | Weyand, Jr. | 242/55 |

*Primary Examiner*—Stuart S. Levy
*Assistant Examiner*—David Werner
*Attorney, Agent, or Firm*—William G. Auton

[57] ABSTRACT

A system for the automatic and continuous loading of composite tape into a tape-laying machine is disclosed. The system provides composite tape from a plurality of cassettes which are held in the magazine of a tape loading system. The tape loading system has a tape drive which feeds tape from a cassette in an active position to the tape-laying system in controlled amounts. The tape loading system also has a cassette transfer system which pushes a full cassette from a standby position into the active position when the cassette in the active position exhausts its supply of tape.

4 Claims, 3 Drawing Sheets

LEGEND:
CASSETTE CHANGER - BACK SIDE

AUTOMATIC LOADING OF COMPOSITE TAPE USING CASSETTES

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to laminating and tape-laying systems, and more specifically to a system of automatically loading composite tape onto tape-laying machines using cassettes.

Automated composite laminating work centers reduce manufacturing costs and provide for high rates of production. Such systems include tape-laying machines, many of which are simply a reel of composite tape mounted on top of a tape-laying head. While the tape-laying functions of such machines are automated, the composite tape is commonly manually loaded when the reels are empty. This dependence upon manual labor entails delays in production for the notification of operators which have to physically acquire full reels, then remove and replace empty reels of tape.

The task of providing an automated system of loading composite tape onto tape-laying machines, by using cassettes, is alleviated to some degree, by the following U.S. Patents, which are incorporated herein by reference:

U.S. Pat. No. 2,341,369 to C. A. Flood on Feb. 8, 1944;

U.S. Pat. No. 2,575,129 issued to J. H. Rubenstein. Nov. 13, 1951;

U.S. Pat. No. 4,024,954 issued to M. J. Staar on May 24, 1977;

U.S. Pat. No. 4,286,790 issued to B. W. Siryj et al on Sep. 1, 1981;

U.S. Pat. No. 4,328,062 issued to J. W. Off et al on May 4, 1982;

U.S. Pat. No. 4,351,688 issued to O. E. Weiss et al on Sep. 28, 1982; and

U.S. Pat. No. 4,453,634 issued to K. Blumenthal on Jun. 12, 1984.

U.S. Pat. No. 2,341,368 discloses a box like dispenser with tape material. U.S. Pat. No. 7,575,129 discloses a typical gravity fed vending machine where packages are dropped to shelves and are ejected by an ejecting member to the vending area. U.S. Pat. No. 4,024,954 discloses a storage magazine having housings which have slidable drawers therein for holding cassettes. U.S. Pat. No. 4,286,790 discloses a changer apparatus where a cartridge is moved from a storage module to a read position by means of an XY ball and screw apparatus. U.S. Pat. No. 4,328,062 discloses an apparatus for depositing adhesive strips from a supply reel. U.S. Pat. No. 4,351,688 discloses a composite tape playing machine wherein the tape is supplied from a supply roll 39 mounted atop the machine. U.S. Pat. No. 4,453,634 discloses a box like dispenser for dispensing strip or tape-like material.

In view of the foregoing discussion, it is apparent that there currently exists the need for a system which automatically loads composite tape into tape-laying machines. The present invention is intended to satisfy that need.

SUMMARY OF THE INVENTION

The present invention is an automated system of loading composite tape onto a tape-laying machine using cassettes.

In the past, composite tape was wound upon spools, which were manually loaded into tape-laying machines. The present invention provides automated loading of composite tape using a plurality of cassettes, and a loading mechanism.

Each cassette holds 1,000 feet of composite tape (tape with paper backing) on a center spool. This center spool is sprocketed on its inside diameter to interface with the tape drive of the tape laying machine.

The loading mechanism contains a cassette magazine which holds a vertical stack of cassettes. A tape drive spindle, cassette, advancing cylinder, advancing ratchet latch and a pinching tape feed drive mechanism are housed in the body of the loading mechanism to sequentially load full cassettes into the tape-laying machine, as it requires tape. A cassette ejection system housed in the loading mechanism ejects empty cassettes from the tape-laying system, as the cassette in use exhausts its supply of tape. The automatic feeding device in the tape laying head is able to automatically feed the tape from the cassette to the laydown roller of the tape-laying machine.

It is a principal object of the present invention to further reduce manufacturing costs and increase rates of production of fabricating systems using tape-laying machines.

It is another object of the present invention to enhance the automation of tape-laying machines and reduce their dependence upon manual operation.

It is another object of the present invention to provide a system of loading tape-laying machines using cassettes filled with rolls of composite tape.

These objects together with other objects, features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

The present invention is an automatic tape loading device which uses cassettes to continuously load composite tape into tape-laying machines.

Figure 1:
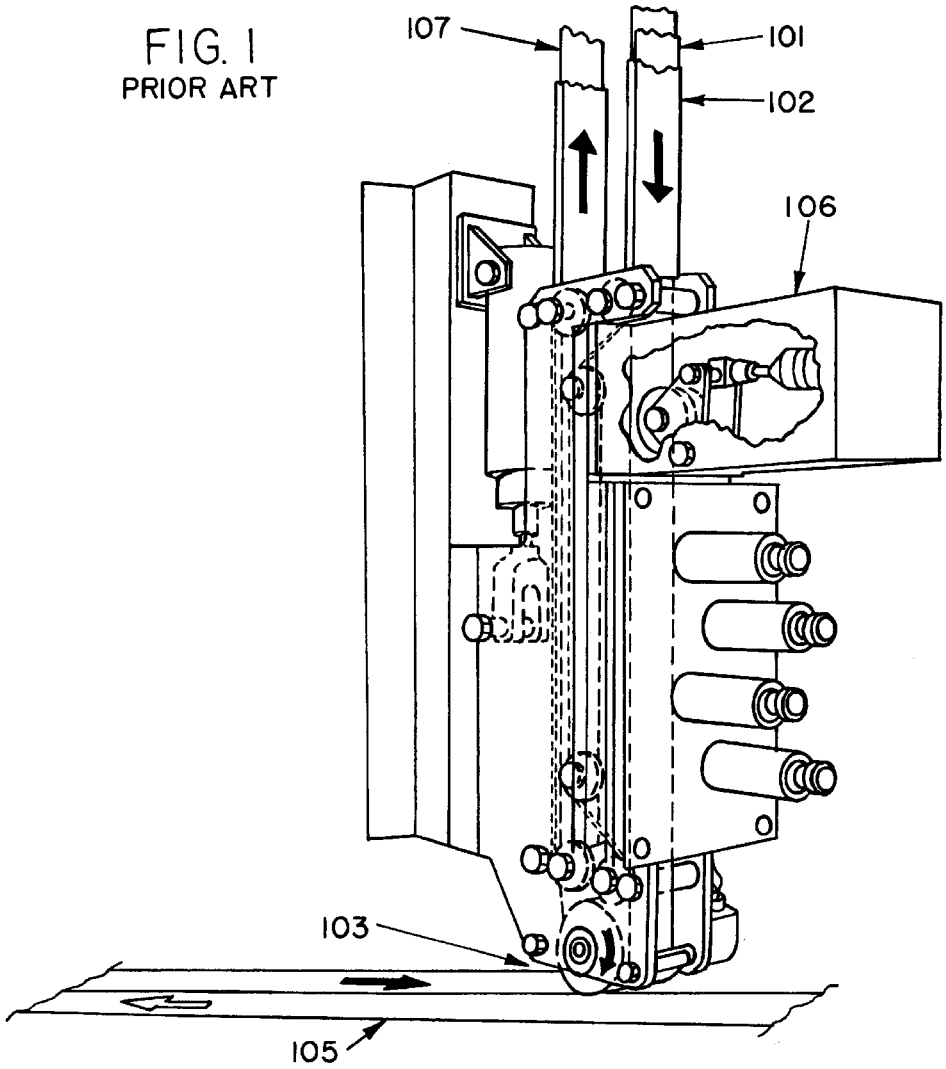
FIG. 1 PRIOR ART
FIG. 1 is an illustration of a prior art tape-laying machine.

The reader's attention is now directed to FIG. 1, which is a detailed illustration of a tape-laying machine. Composite tape 101, which has a paper backing, is fed into the tape laying machine via a casing 102. This tape passes down the casing 102 to the laydown roller 103 where the backing 4s separated and the tape 105 is positioned on the workpiece. There exists a sheer mechanism 106 which is capable of severing the tape upon receiving a digital command signal from the system controller.

The paper backing of the composite tape 107 exits the tape laying machine out an exit casing where it may be collected in a take-up reel or a hopper. The source of the tape for the system of FIG. 1 is a supply reel which is initially loaded manually, and must be manually replaced when the reel is empty. The use of such a reel is depicted schematically in FIG. 2.

Figure 2:
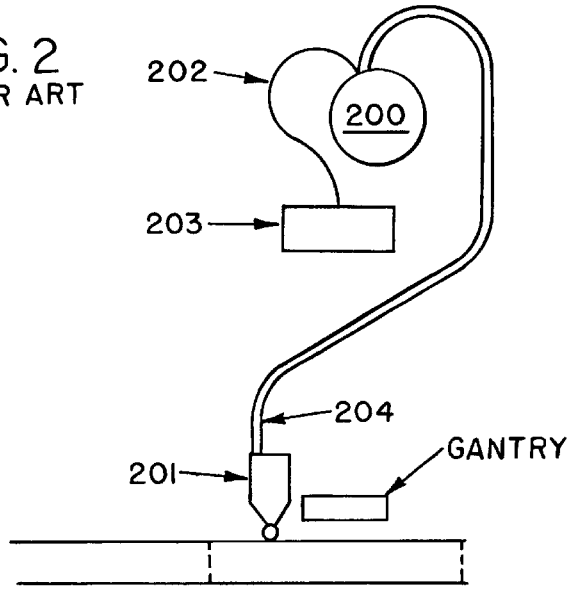
FIG. 2 PRIOR ART
FIG. 2 is a mechanical schematic of a prior art tape-laying machine which receives composite tape from reels.

FIG. 2 is a mechanical schematic of a conventional tape-laying system. FIG. 2 depicts the reel 200 as the source of composite tape for the tape laying head 201. The backing paper 202 in this system is removed into a hopper 203 for disposal, while the tape itself is conducted through a hollow tape transfer tube 204 to the tape-laying head 201 for application onto a workpiece.

The purpose of the present invention is to eliminate the manual activity of supplying composite tape to tape-laying systems. The principle of the present invention entails the provision of composite tape which is loaded into a cassette (FIG. 3) containing a roller to dispense the tape through a tape laying chute to the laydown roller once the cassette is in position. When emptied, the cassette is pushed out by the next cassette, which is continuously and automatically supplied by the tape loading mechanism (FIGS. 4A and 4B) of the present invention.

Figure 3:
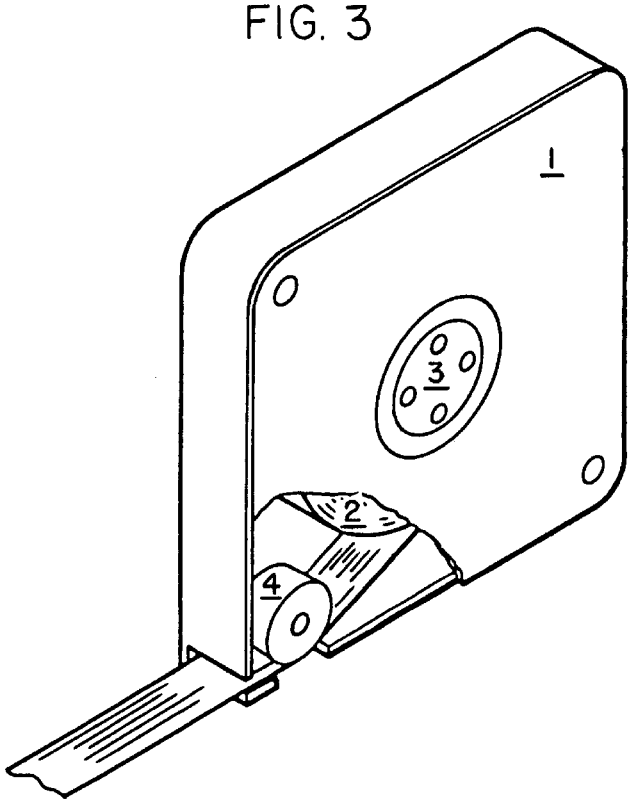
FIG. 3 is an assembly view of a cassette of composite tape used in the present invention.

FIG. 3 is an assembly view of a cassette that shows the cassette with tape wound on a spool and loaded inside. The principal elements of the cassette are as follows:

(1) is the cassette housing;

(2) is the tape spool on which the tape is wound;

(3) is the sprocketed inside diameter of the spool;

(4) is the tape-feed roller that helps drive the tape out of the cassette.

FIG. 3 is an illustration of one of the plurality of cassettes for dispensing composite tape used in the present invention. The cassette of FIG. 3 has a width of 1¼ inches, and a length and breadth of 12¾ inches. Such a cassette holds 1,000 feet of composite tape with backing paper on a central reel. As depicted in FIG. 3, the inside diameter of the central reel is sprocketed to interface with the drive on the tape playing machine. Each cassette has a dispensing roller and chute in one corner out which the tape is fed to the tape laying machine.

Figure 4A:
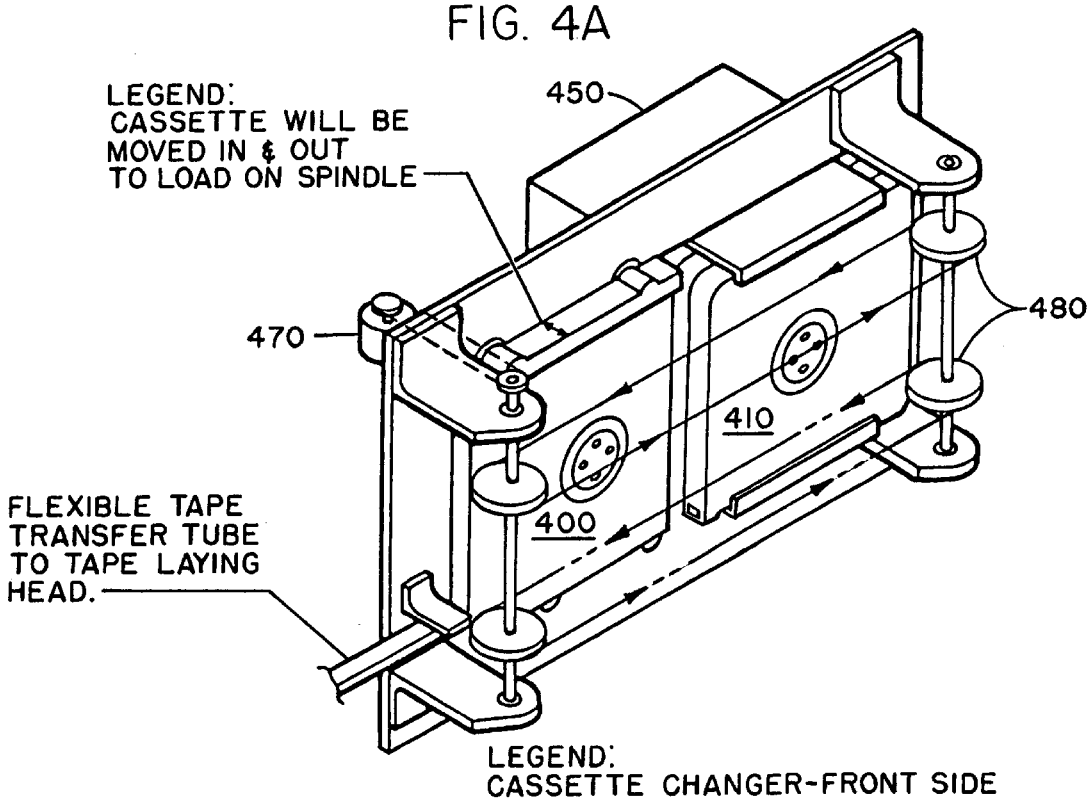
FIGS. 4A and 4B are mechanical schematics of the automatic loading system of the present invention.
Figure 4B:
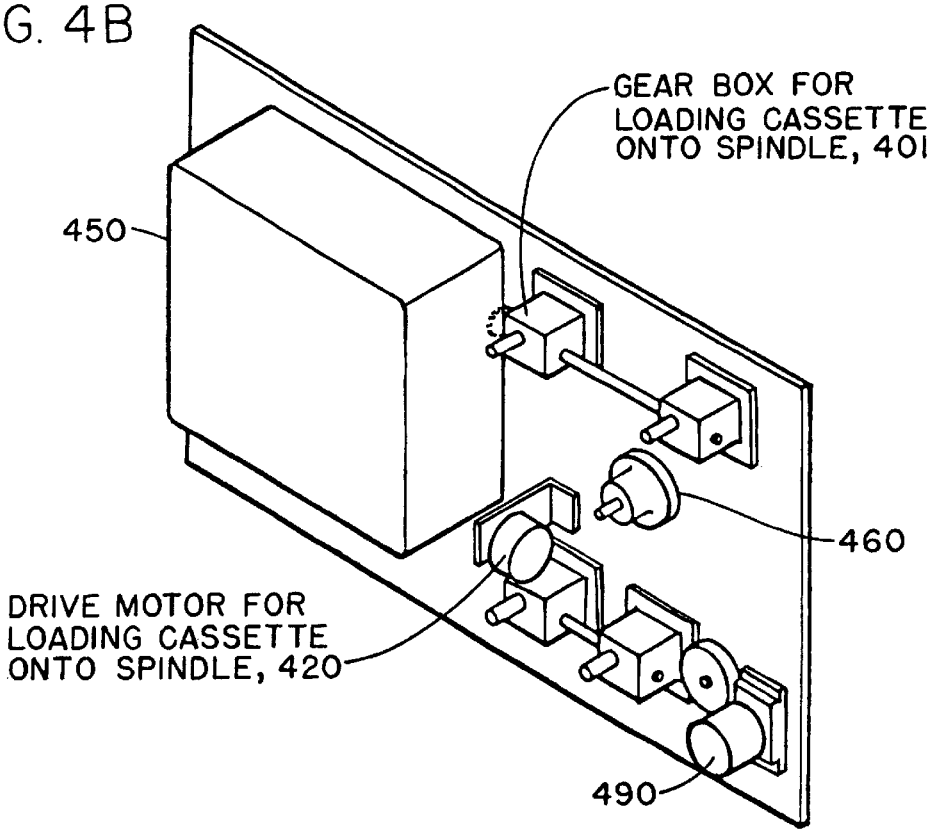

FIGS. 4A and 4B are mechanical schematics of the automatic loading system of the present invention. The principal elements of the automatic loading system are as follows:

450 is a cassette magazine that holds full cassettes;

460 is a tape-drive spindle;

470 is a cassette advancing motor;

480 and 481 depict first and second chain drives; and

490 is a pinching tape-feed drive mechanism.

Figure 5:
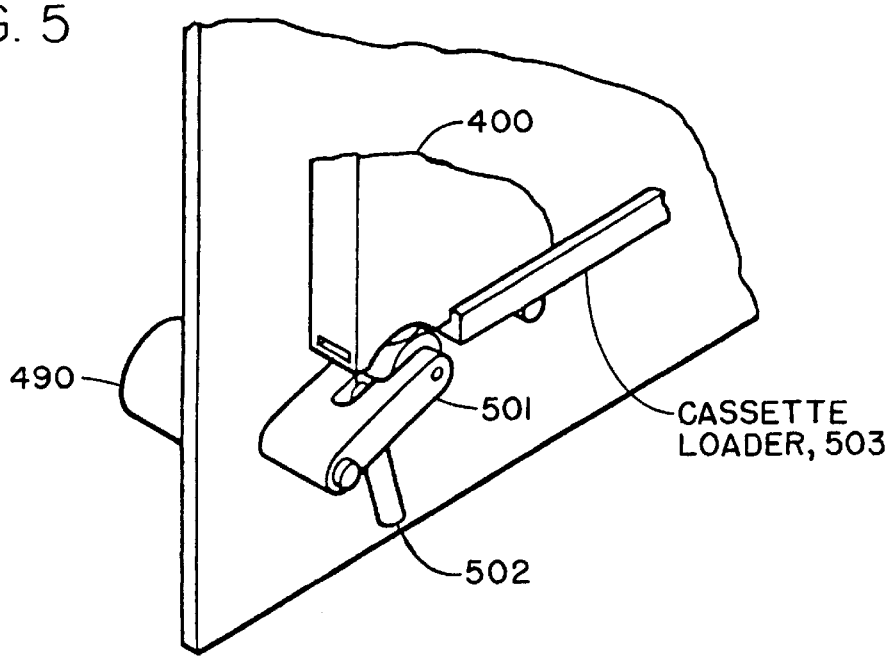
FIG. 5 is a detailed illustration of the tape feed mechanism of the system of FIGS. 4A and 4B.

FIG. 5 is a detailed illustration of the tape feed mechanism of the automatic loading system of FIGS. 4A and 4B. Operation of the system is as follows. The cassettes are loaded into the magazine or cartridge 450 for use by the tape-laying head. The cassette, which is engaged with the spindle, supplies composite tape for the tape-laying head in much the same manner as a reel of tape would. However, when the cassette, engage with the spindle is empty, the tape drive spindle 460 is retracted, and the cassette transfer drive motor 470, and the first and second chain drives 480 and 481 push a full cassette down the guide chutes into position in front of the spindle 460. This action simultaneously acts as an empty cassette ejection system as the forward motion of the full cassette pushes the empty cassette out where it can fall into a hopper or similar container.

When a new full cassette is in place, the tape drive spindle 460 engages the sprocketed tape spool of the cassette. The tape feed roller 501 raises (via air cylinder 501) and contacts the tape feed drive roller 4 in the cassette to feed out the tape into the tape-laying head. When a new full cassette is placed in position, the magazine provides another full cassette in the position formerly occupied by the new full cassette which is in use. If the magazine contains vertically stacked cassettes, the cassettes can be gravity-fed into the position vacated by the full cassette as it is put into use. Of course, a spring-loaded magazine of cassettes need not be vertically stacked, but can provide a new cassette from a stack in any orientation.

While two chain drives 480 and 481 and the cassette transfer drive motor are depicted in FIG. 4A as the means of positioning a full cassette in place of an empty cassette, alternative means exist for transferring cassettes. In another embodiment of the present invention, a cassette advancing cylinder was used to push the full cassette along the guide chutes to the retracting spindle 460 so that it could replace the empty cassette.

As thus described, the present invention is characterized to include devices that automatically load composite tape into a tape-laying head. These consist of cassettes for holding and conveying the composite tape and a loading mechanism that stores the cassettes, ejects empty cassettes, loads full cassettes onto the head, and interfaces with the heads' tape drive system.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. In combination with a tape-laying system containing a tape-laying head that receives and deposits composite tape onto a workpiece, an automatic tape supply system which supplies said tape-laying system with composite tape, said automatic supply system comprising;

a plurality of cassettes containing composite tape, and wherein each of said plurality of cassettes includes: a housing; a tape spool which is centrally mounted in said housing, said tape spool containing a roll of composite tape wound upon it, said tape spool having a sprocketed inside diameter which allows said cassette loading system to roll controlled amounts of composite tape from it; and a first tape feed roller mounted in said housing and receiving a stream of composite tape from said tape spool, said first tape feed roller rotating to help drive said stream of tape out of said housing; and a cassette loading system which: stores said plurality of cassettes, supplies tape from said plurality of cassettes to said tape-laying head, and ejects cassettes when they exhaust their supply of composite tape.

2. An automatic supply system, as defined in claim 1, wherein said cassette loading system comprises:

a cassette magazine which holds said plurality of cassettes;

a frame connected to said cassette magazine and receiving cassettes from said cassette magazine in a standby position where each cassette waits to be used, said frame having an active cassette in an active position which is aligned with the cassette in the standby position by guide chutes in said frame;

a tape drive means housed in said frame and engaging with cassettes which are in the active position and driving them to feed tape in controlled amounts, said tape drive means disengaging from cassettes when they exhaust their supply of composite tape; and a cassette transfer means which is mounted in said frame and pushes cassettes from the standby position along the guide chutes to the active position when the cassette in the active position exhausts its supply of tape and becomes empty, said cassette transfer means thereby pushing out empty cassettes and replacing them with full cassettes for use by said tape-laying system.

3. An automatic supply system as defined in claim 2, wherein said tape drive means comprises:

a retractable spindle mounted in said frame and engaging the sprocketed inside diameter of the tape spool of cassettes in the active position of the frame, said retractable spindle thereby allowing the tape spool to rotate so that tape may be fed from the cassette in the active position to the tape-laying system, said retractable spindle retracting to disengage from cassettes when they exhaust their supply of tape;

a second tape feed roller which, when advanced, engages the first tape feed roller mounted in the housing of the cassette in the active position of the frame, said second tape feed roller rotating to advance the stream of tape which unwinds from the tape spool and passes between the first and second tape feed rollers to the tape-laying head of the tape laying system;

a tape feed drive motor which is housed in said frame and rotates said second tape feed roller in controlled amounts, said tape drive motor thereby feeding tape from the cassette in the active position of the frame to the tape-laying system; and a means for advancing the second tape feed roller so that it engages the first tape feed roller in the cassette in the active position of the frame.

4. An automatic supply system, as defined in claim 3, wherein said cassette transfer means comprises:

first and second chain drives, said first chain drive being mounted in said frame in proximity with the cassette in the active position;

said second chain drive being mounted in said frame in proximity with the cassette in the standby position;

a drive chain mounted between the first and second chain drive so that when the first chain drive is rotated, the drive chain is placed in motion such that it pushes the cassette in the standby position along the guide chutes of the frame so that it is moved into the active position of the frame and may supply composite tape to the tape-laying head; and a cassette transfer drive motor which is attached to the frame and rotates the first chain drive to cause the drive chain to move when the cassette in the active position runs out of composite tape.

* * * * *